US011333994B2

(12) United States Patent
Park et al.

(10) Patent No.: US 11,333,994 B2
(45) Date of Patent: May 17, 2022

(54) CONTROLLING AMOUNT OF DEVELOPER BY USING OUTPUT WAVEFORM OBTAINED FROM TONER CONCENTRATION SENSOR

(71) Applicant: Hewlett-Packard Development Company, L.P., Spring, TX (US)

(72) Inventors: Youngjin Park, Seongnam-si (KR); Donggeun Lee, Seongnam-si (KR)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 17/271,262

(22) PCT Filed: Jun. 12, 2019

(86) PCT No.: PCT/US2019/036775

§ 371 (c)(1),
(2) Date: Feb. 25, 2021

(87) PCT Pub. No.: WO2020/185243

PCT Pub. Date: Sep. 17, 2020

(65) Prior Publication Data

US 2021/0341856 A1 Nov. 4, 2021

(30) Foreign Application Priority Data

Mar. 8, 2019 (KR) ..... 10-2019-0026606

(51) Int. Cl.
*G03G 15/08* (2006.01)
*G03G 15/00* (2006.01)

(52) U.S. Cl.
CPC ..... *G03G 15/0844* (2013.01); *G03G 15/0853* (2013.01); *G03G 15/556* (2013.01); *G03G 15/0856* (2013.01)

(58) Field of Classification Search
CPC ..... G03G 15/556; G03G 15/0844; G03G 15/0849; G03G 15/0853; G03G 2215/0888
(Continued)

(56) References Cited

U.S. PATENT DOCUMENTS 8,238,768 B2 8/2012 Koizumi et al.
9,696,654 B2 7/2017 Nakayama et al.
(Continued)

FOREIGN PATENT DOCUMENTS

EP 0 542 276 B1 6/1996
EP 1 607 804 A2 12/2005
(Continued)

*Primary Examiner* — Robert B Beatty
(74) *Attorney, Agent, or Firm* — Jefferson IP Law, LLP

(57) ABSTRACT

An image forming apparatus measures, using a toner concentration sensor installed in a developing apparatus of the image forming apparatus, a toner concentration of a developer stored in the developing apparatus to obtain an output waveform. The image forming apparatus calculates, based on the output waveform, a first characteristic value corresponding to a volume of the developer. Based on a result of comparing the first characteristic value with a reference value calculated from a reference output waveform obtained in an initial state of the developing apparatus, the image forming apparatus determines whether to execute a discharge mode for discharging the developer from the developing apparatus and to control an amount of the developer. The image forming apparatus discharges, according to a result of the determining, a portion of the developer from the developing apparatus by controlling a driving speed of the developing apparatus when the discharge mode is executed.

15 Claims, 11 Drawing Sheets

(58) Field of Classification Search
USPC ..... 399/29, 30, 62, 257
See application file for complete search history.

(56) References Cited

U.S. PATENT DOCUMENTS

| | | | | |
|---|---|---|---|---|
| 2007/0053703 | A1 | 3/2007 | Hirayama | |
| 2007/0127934 | A1 | 6/2007 | Shoji et al. | |
| 2009/0060534 | A1* | 3/2009 | Murauchi ..... | G03G 15/0822 399/30 |
| 2010/0226664 | A1 | 9/2010 | Yoshida et al. | |
| 2019/0033750 | A1* | 1/2019 | Sakurai ..... | G03G 15/0865 |
| 2019/0243280 | A1* | 8/2019 | Wakisaka ..... | G03G 15/0849 |

FOREIGN PATENT DOCUMENTS

| | | | | |
|---|---|---|---|---|
| JP | 10-78700 | A | | 3/1998 |
| JP | 2001-201933 | A | | 7/2001 |
| JP | 2006-30952 | A | | 2/2006 |
| JP | 2009-244552 | A | | 10/2009 |
| JP | 2015-191077 | A | | 11/2015 |
| JP | 2017049359 | A | * | 3/2017 |

* cited by examiner

610

| SPEED | INITIAL WEIGHT | WEIGHT AFTER LOW-SPEED DRIVING | WEIGHT AFTER FULL-SPEED DRIVING | DISCHARGE AMOUNT |
|---|---|---|---|---|
| 70ppm | 1130.0 | 1129.1 | 1127.0 | 3.0 |
| 60ppm | 1130.0 | 1129.9 | 1127.5 | 2.5 |
| 50ppm | 1130.0 | 1130.0 | 1129.0 | 1.0 |
| 40ppm | 1130.0 | 1130.0 | 1129.4 | 0.6 |

620

710

| SPEED | INITIAL WEIGHT | WEIGHT AFTER LOW-SPEED DRIVING | WEIGHT AFTER FULL-SPEED DRIVING | DISCHARGE AMOUNT |
|---|---|---|---|---|
| 70ppm | 1073.0 | 1073.0 | 1072.9 | 0.1 |
| 60ppm | 1073.0 | 1073.0 | 1072.9 | 0.2 |
| 50ppm | 1073.0 | 1073.0 | 1072.9 | 0.1 |
| 40ppm | 1073.0 | 1073.0 | 1073.0 | 0.0 |

720

910

| THE AMOUNT OF INITIAL CHARGE | 40ppm | 50ppm | 60ppm | 70ppm |
|---|---|---|---|---|
| 265g | 0.0 | 0.0 | 0.0 | 0.0 |
| 275g | 0.0 | 0.0 | 0.0 | 0.0 |
| 285g | 0.0 | 0.0 | 0.0 | 0.0 |
| 295g | 0.0 | 0.0 | 0.0 | 0.7 |
| 305g | 0.0 | 0.0 | 2.2 | 3.3 |
| 315g | 2.8 | 2.7 | 4.9 | 6.7 |
| 325g | 6.1 | 5.8 | 7.3 | 9.9 |
| 335g | 8.8 | 8.9 | 9.6 | 12.1 |

FIG. 10

1010

| | DRIVING TIME ACCORDING TO DRIVING SPEED OF DEVELOPING APPARATUS IN DISCHARGE MODE (SEC) | | | | | | | | | | |
|---|---|---|---|---|---|---|---|---|---|---|---|
| | EI0 | EI1 | EI2 | EI3 | EI4 | EI5 | EI6 | EI7 | EI8 | EI9 | EI10 |
| 70ppm | 20 | 20 | 20 | 20 | 40 | 40 | 40 | 40 | 40 | 40 | 40 |
| 60ppm | 20 | 20 | 20 | 20 | 40 | 40 | 40 | 40 | 40 | 40 | 40 |
| 50ppm | 20 | 20 | 20 | 20 | 40 | 40 | 40 | 40 | 40 | 40 | 40 |
| 40ppm | 20 | 20 | 20 | 20 | 40 | 40 | 40 | 40 | 40 | 40 | 40 |

CONTROLLING AMOUNT OF DEVELOPER BY USING OUTPUT WAVEFORM OBTAINED FROM TONER CONCENTRATION SENSOR

BACKGROUND

Described herein is an image forming apparatus which uses an electrophotographic method and supplies toner to an electrostatic latent image formed on a photoconductor to form a visible toner image on the photoconductor, transfers the toner image to a printing medium via an intermediate transfer medium or directly to a printing medium, and then fixes the transferred toner image on the printing medium.

BRIEF DESCRIPTION OF THE DRAWINGS

FIG. 10 is a view for explaining a driving time set according to a driving speed of a developing apparatus in a discharge mode of the developing apparatus, according to an example.

DETAILED DESCRIPTION

An "image forming apparatus" may be any device capable of performing an image forming job, such as a printer, a scanner, a fax machine, a multi-function printer (MFP), or a display device. The "image forming job" may include at least one of printing, scanning, or faxing.

Below, a detailed description will be given about examples of the disclosure with reference to attached drawings. In this regard, the disclosure may have different forms and should not be construed as being limited to the descriptions set forth herein.

Figure 1A:
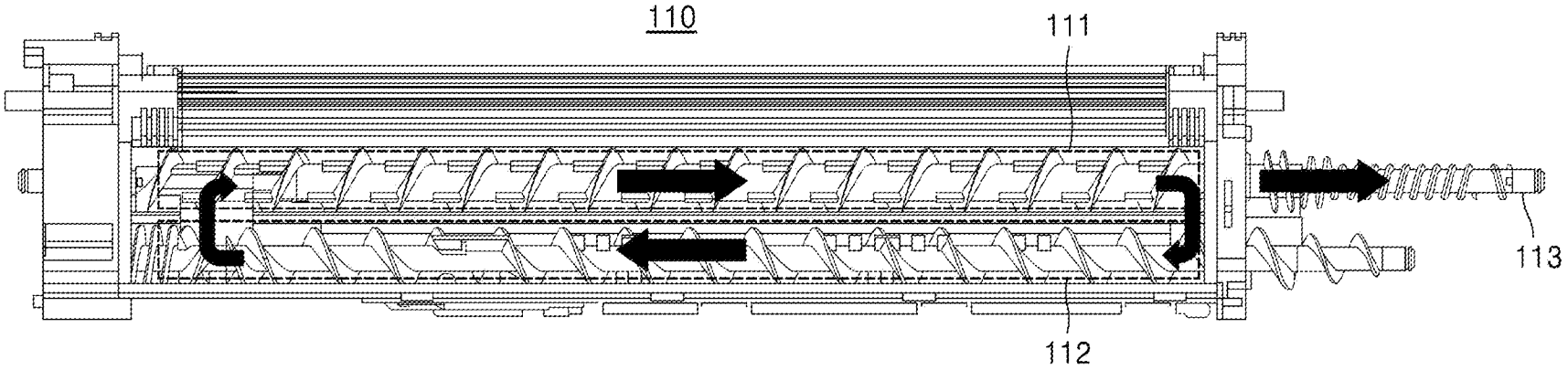
FIGS. 1A and 1B are conceptual diagrams for explaining an operation of controlling the amount of developer by sensing a toner concentration of a developing apparatus in an image forming apparatus, according to an example.
Figure 1B:
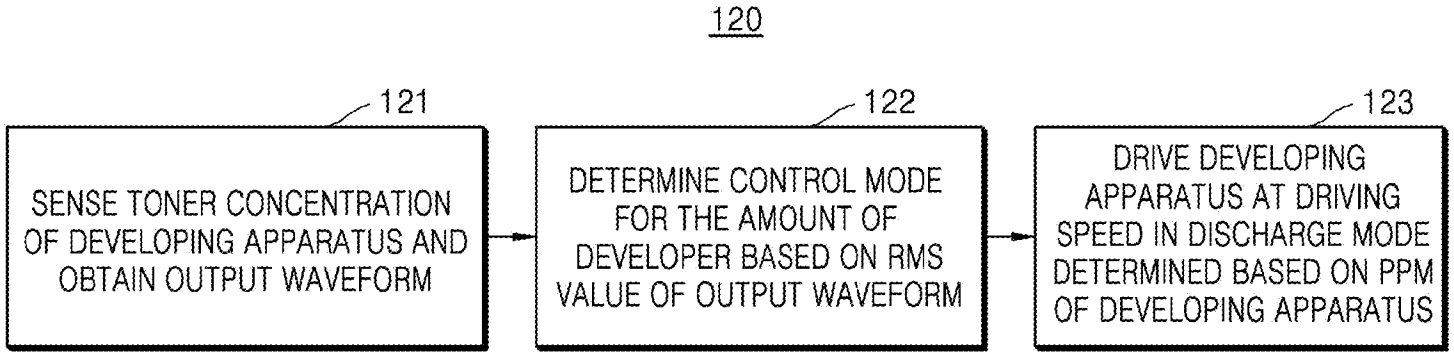

FIGS. 1A and 1B are conceptual diagrams for explaining an operation of controlling the amount of developer by sensing a toner concentration of a developing apparatus in an image forming apparatus, according to an example.

An image 110 of FIG. 1A is a view showing the inside of the developing apparatus of the image forming apparatus. The developing apparatus may be supplied with developer. The developer may include toner and a carrier. The developer in the developing apparatus may be circulated clockwise as an auger is rotated, as shown in the image 110 of FIG. 1A. As the developing apparatus is driven, the developing apparatus may discharge a certain amount of the developer through an outlet 113. The image forming apparatus may control driving of the developing apparatus so that the developer in the developing apparatus may be maintained in a constant amount by an auto developer replenishment (ADR) method.

For example, according to a change of a driving speed of the developing apparatus, the image forming apparatus may discharge developer through the outlet 113 by inducing a difference between the amount of developer distributed in a first area 111 and the amount of developer distributed in a second area 112 in the developing apparatus. In another example, the image forming apparatus may increase force received by the developer in a direction of the outlet 113 by increasing a driving speed of the developing apparatus, thereby discharging the developer through the outlet 113.

The image forming apparatus may control driving of the developing apparatus so that the amount of developer may be maintained in accordance with a driving speed of the developing apparatus by using an output waveform output from a toner concentration (TC) sensor in the image forming apparatus.

For example, referring to a diagram 120 of FIG. 1B, in block 121, the image forming apparatus may use the TC sensor of the developing apparatus to sense a toner concentration of the developing apparatus and obtain an output waveform. In block 122, the image forming apparatus may calculate a root mean square (RMS) value of the output waveform and determine a control mode of the amount of developer based on the RMS value. For example, when the difference between an RMS value and an RMS value of an output waveform sensed by the reference amount of developer of the developing apparatus is greater than or equal to a certain value, the image forming apparatus may determine execution of a discharge mode for discharging the amount of the developer. In block 123, the image forming apparatus may drive the developing apparatus at a driving speed of a discharge mode determined based on ppm of the developing apparatus, thereby discharging developer. In FIGS. 2 to 11, a method of controlling the amount of developer in a developing apparatus by using an output waveform output from a TC sensor of an image forming apparatus will be described in detail.

Figure 2:
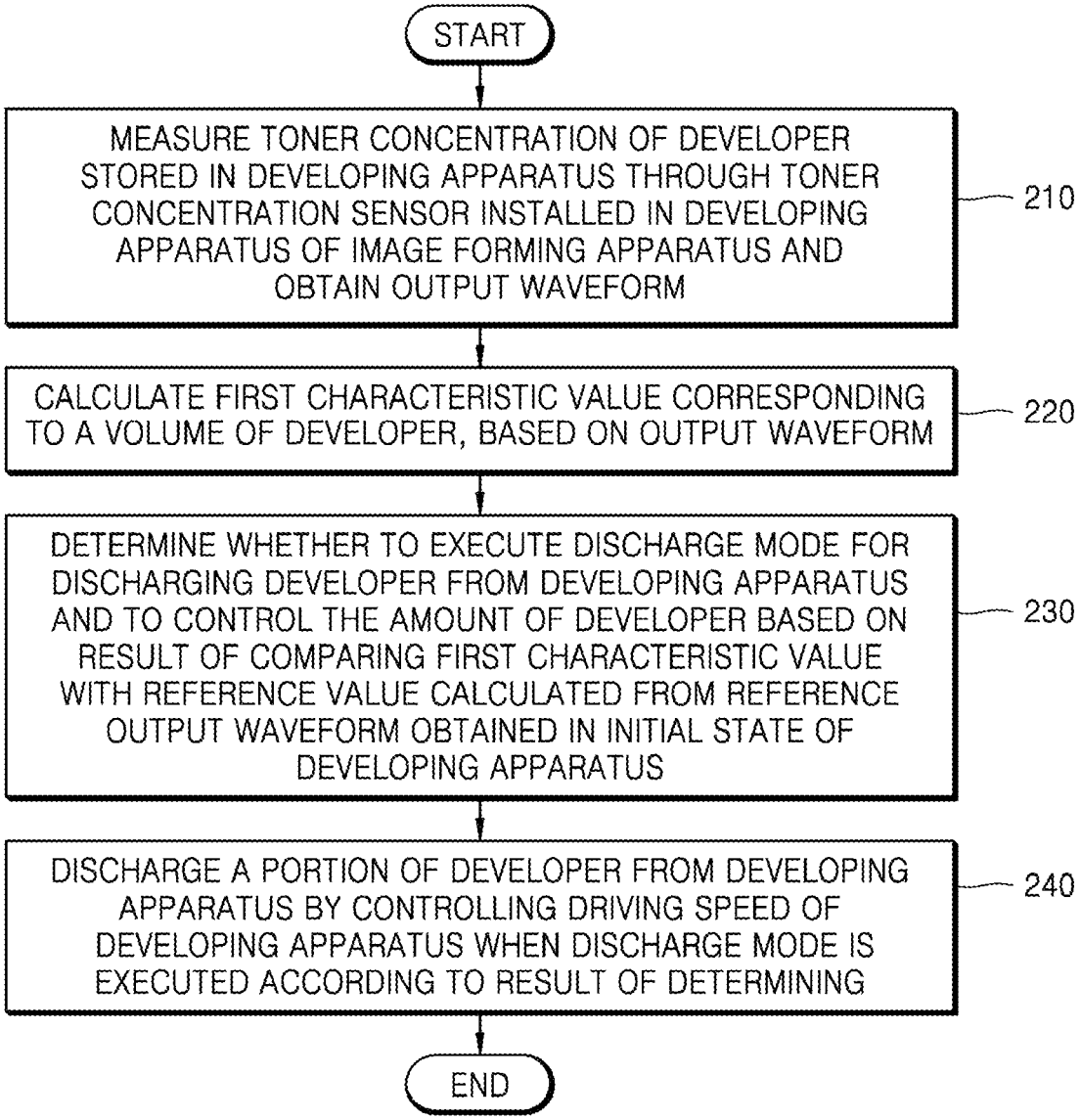
FIG. 2 is a flowchart of an operating method of an image forming apparatus, according to an example.

FIG. 2 is a flowchart of an operating method of an image forming apparatus, according to an example.

In operation 210 of an image forming apparatus 10, the image forming apparatus 10 may measure a toner concentration of a developer stored in a developing apparatus 1110 through the TC sensor and obtain an output waveform corresponding to the toner concentration. The TC sensor may be installed in the developing apparatus 1110 of the image forming apparatus 10.

The image forming apparatus 10 may adjust a control voltage applied to the TC sensor during a non-output operation of the image forming apparatus 10. The image forming apparatus 10 may obtain a corrected output waveform by aligning a value of a maximum voltage of the output waveform with a preset reference voltage based on the control voltage.

In operation 220 of the image forming apparatus 10, the image forming apparatus 10 may obtain a first characteristic value corresponding to the volume of the developer, based on the output waveform.

For example, the image forming apparatus 10 may calculate an RMS value of the corrected output waveform to obtain the first characteristic value. Further, the image forming apparatus 10 may obtain an output waveform corresponding to each color provided in the image forming apparatus 10, and may obtain a characteristic value from the output waveform.

In operation 230 of the image forming apparatus 10, the image forming apparatus 10 may compare the first characteristic value with a reference value. The image forming apparatus 10 may determine whether to execute a discharge mode for discharging the developer from the developing apparatus 1110 and to control an amount of the developer based on a result of the comparison.

Here, the reference value is a value calculated from a reference output waveform of the developing apparatus 1110. The reference output waveform is a waveform in which a toner concentration of a developer in an initial state of the developing apparatus 1110 through the TC sensor is measured and output.

For example, before the developing apparatus 1110 is newly installed in the image forming apparatus 10 and a first image forming job is performed in the image forming apparatus 10, the image forming apparatus 10 may measure the toner concentration of the developer stored in the developing apparatus 1110 through the TC sensor to obtain the reference output waveform. The image forming apparatus 10 may obtain an RMS value of the reference output waveform and store the RMS value as the reference value of the developing apparatus 1110.

For example, when a difference between the reference value and the first characteristic value is greater than a preset value, the image forming apparatus 10 may determine that the amount of the developer in the developing apparatus 1110 exceeds the reference amount of developer. The reference amount of the developer is the amount of developer to be maintained in the developing apparatus 1110 in order to smoothly perform an image forming job in the image forming apparatus 10. The image forming apparatus 10 may determine execution of a discharge mode to maintain the amount of the developer in the developing apparatus 1110 at the reference amount of the developer.

Meanwhile, a time at which the image forming apparatus 10 determines whether to execute the discharge mode may be a time of execution of a preparation operation of the image forming apparatus 10. Further, when it is determined that the image forming apparatus 10 is to execute the discharge mode, the image forming apparatus 10 may output alarm information regarding execution of the discharge mode.

In operation 240 of the image forming apparatus 10, when the discharge mode is executed in the image forming apparatus 10 in accordance with a determination result, the image forming apparatus 10 may discharge a portion of the developer from the developing apparatus 1110 by controlling a driving speed of the developing apparatus 1110.

For example, when the discharge mode is executed at a first speed at which a driving speed of the developing apparatus 1110 is greater than a preset speed, the image forming apparatus 10 may induce a change in the distribution of the developer in the developing apparatus 1110 in accordance with a change of reducing and then increasing the driving speed of the developing apparatus 1110. The image forming apparatus 10 may discharge the amount of developer exceeding the reference amount of the developer due to the change in the distribution of the developer in the developing apparatus 1110.

In more detail, the image forming apparatus 10 may discharge a first amount of the developer while reducing the driving speed of the developing apparatus 1110 from the first speed to a second speed less than the preset speed during a first driving time. The image forming apparatus 10 may discharge a second amount of the developer while increasing the driving speed of the developing apparatus 1110 from the second speed to the first speed during a second driving time.

In another example, when the discharge mode is executed at a speed at which the driving speed of the developing apparatus 1110 is less than a preset speed, the developing apparatus 1110 may discharge the amount of developer exceeding the reference amount of the developer by increasing the driving speed of the developing apparatus 1110 to a speed greater than the preset speed.

In more detail, the image forming apparatus 10 may increase the driving speed of the developing apparatus 1110 to a driving speed designed to maintain the reference amount of the developer according to driving of the developing apparatus 1110 during a third driving time, thereby discharging the amount of the developer exceeding the reference amount of the developer from the developing apparatus 1110.

The image forming apparatus 10 may actively maintain an appropriate amount of developer according to the driving speed of the developing apparatus 1110 by using an output waveform output from the TC sensor provided in the developing apparatus 1110.

Figure 3:
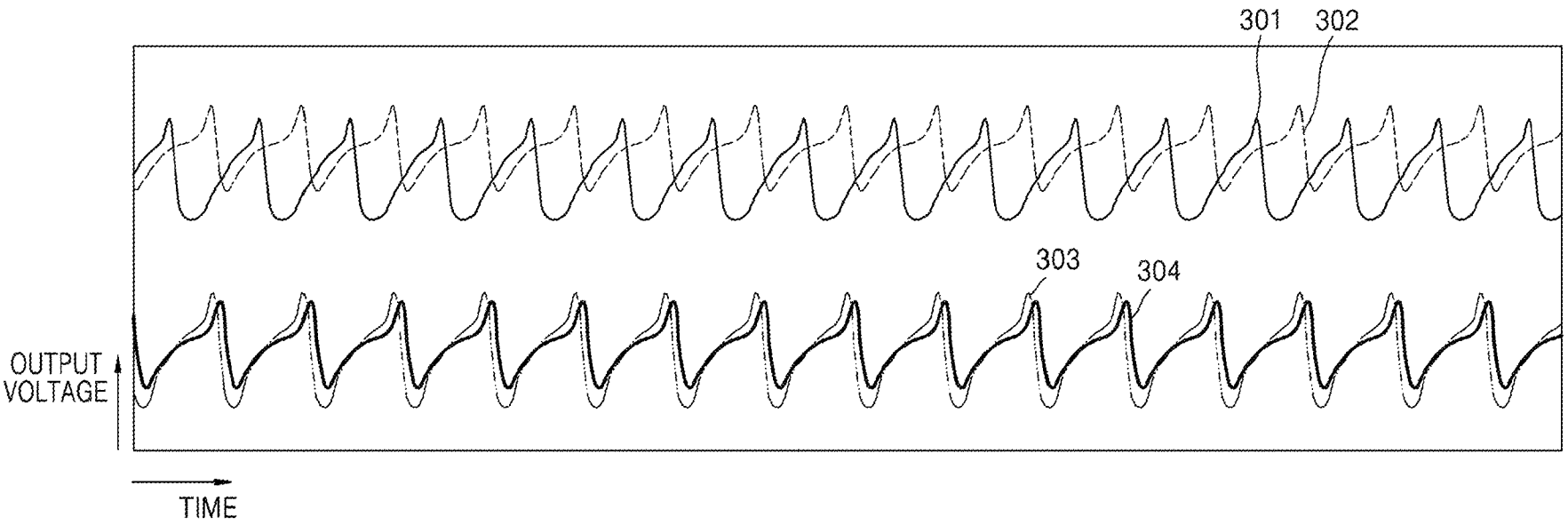
FIG. 3 is a view for explaining the correlation between an output voltage output from a toner concentration sensor and the volume of a developer, according to an example.

FIG. 3 is a view for explaining the correlation between an output voltage output from a toner concentration sensor and the volume of a developer, according to an example.

Developer in the developing apparatus 1110 may be transferred by an auger of the developing apparatus 1110. The TC sensor in the developing apparatus 1110 may measure a toner concentration of the developer in the forming apparatus 1110 and obtain a voltage value corresponding to the toner concentration. As shown in FIG. 3, the TC sensor may obtain an output waveform of the same period as a rotation period of the auger. For example, the output waveform may include a sine waveform. The output waveform may be changed to at least one of a change in the toner concentration, a change in the volume of the developer, and a change in the density of the developer within a detection range where the toner is detected by the toner density sensor. For example, when the volume of the developer changes within the detection range of the TC sensor, a shape of the overall output waveform may change as an output value of the TC sensor changes.

Referring to the graph of FIG. 3, the output waveform is output from the TC sensor. For example, a first output waveform 301 is the output waveform of the TC sensor for a first developing apparatus. Here, the first output waveform 301 is an output waveform of the TC sensor with respect to a reference amount of developer of the first developing apparatus. For example, when the developer is increased by 40 g while constantly maintaining toner concentration in the first developing apparatus, a second output waveform 302 may be output from the TC sensor of the first developing apparatus. A peak-to-peak value within one period of the second output waveform 302 may be less than a peak-to-peak value within one period of the first output waveform 301. Also, a falling time within one period of the second output waveform 302 may be less than a falling time within one period of the first output waveform 301. The falling time may be time from a maximum value to a minimum value within one period of an output waveform. Further, when the amount of the developer in the first developing apparatus is increased by 40 g, an instantaneous density of permeability in a limited space of the first developing apparatus is also increased so that a maximum value output from the TC sensor of the first developing apparatus may also be increased. That is, when there is a change in the volume of the developer in the first developing apparatus, an output waveform output from the TC sensor of the first developing apparatus also changes.

For example, a third output waveform 303 is the output waveform of the TC sensor for a second developing apparatus. Here, the third output waveform 303 is an output waveform of the TC sensor with respect to a reference amount of developer of the second developing apparatus. For example, when the developer is increased by 20 g while constantly maintaining toner concentration in the second developing apparatus, a fourth output waveform 304 may be output from the TC sensor of the second developing apparatus. A peak-to-peak value within one period of the fourth output waveform 304 may be less than a peak-to-peak value within one period of the third output waveform 303. Also, a falling time within one period of the fourth output waveform 304 may be less than a falling time within one period of the third output waveform 303. Further, when the amount of the developer in the second developing apparatus is increased by 20 g, an instantaneous density of permeability in a limited space of the second developing apparatus is also increased so that a maximum value output from the TC sensor of the second developing apparatus may also be increased. That is, when there is a change in the volume of the developer in the second developing apparatus, an output waveform output from the TC sensor of the second developing apparatus also changes.

As the volume of the developer in the developing apparatus 1110 increases, the amount of developer to be discharged and filled by an auger in a detection range region of the TC sensor is increased, so that a maximum value output from the TC sensor may be increased. Therefore, the volume of the developer may affect the output waveform output from the TC sensor.

Meanwhile, a maximum value, an average value, or an RMS value within one cycle of the output waveform may indicate a change in the output waveform. For example, the RMS value may indicate a change in the output waveform with a value representing a width of the output waveform, so that a difference between the first output waveform 301 and the second output waveform 302 may be quantified by an RMS value of each of output waveforms. Since the RMS value of the output waveform increases as the volume of the developer increases, a relationship between the volume of the developer and the RMS value of the output waveform may be proportional.

Figure 4:
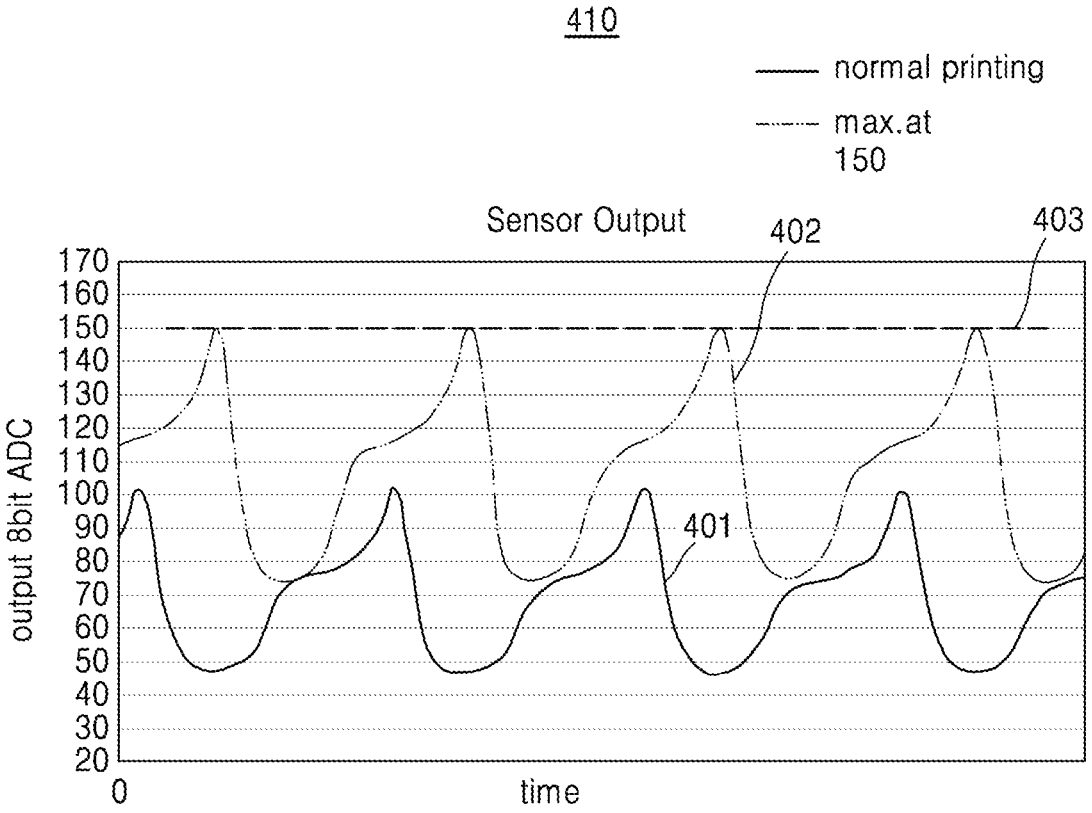
FIG. 4 is a view of a method of aligning an output waveform obtained in a toner concentration sensor, according to an example.

FIG. 4 is a view of a method of aligning an output waveform obtained in a TC sensor, according to an example.

The output waveform output from the TC sensor of the image forming apparatus 10 may be output according to fluctuation of a toner concentration level. Therefore, an output waveform with respect to the volume of the same developer may vary. The image forming apparatus 10 may adjust a control voltage applied to the TC sensor. For example, the control voltage may be controlled to increase or decrease by a preset voltage at a certain voltage. The image forming apparatus 10 may obtain a corrected output waveform by aligning a value of a maximum voltage of the output waveform with a preset reference voltage based on the control voltage.

Referring to a graph 410 of FIG. 4, the image forming apparatus 10 may obtain a first output waveform 401 through the TC sensor. The image forming apparatus 10 may adjust a voltage applied to the TC sensor so that the first output waveform 401 may be physically aligned such that a maximum voltage of the first output waveform 401 is aligned to 150, which is a reference ADC 403. The ADC is a value obtained by converting a voltage value output from the TC sensor into 8 bits. In addition, the reference ADC 403 may be a value corresponding to a reference voltage used to physically align the first output waveform 401. The image forming apparatus 10 may physically align the first output waveform 401 to obtain a second output waveform 402. The image forming apparatus 10 may calculate an RMS value of the second output waveform 402.

That is, the image forming apparatus 10 may obtain a corrected output voltage by aligning a maximum value of an output voltage output from the TC sensor to 150 which is the reference ADC 403. The image forming apparatus 10 may obtain an output value for the same volume of the developer by calculating an RMS value of the corrected output voltage.

Meanwhile, when the control voltage of the TC sensor is adjusted during an image forming job in the image forming apparatus 10, the supply of toner may be affected and the image forming job may not be performed smoothly. Thus, the image forming apparatus 10 may adjust a control voltage applied to the TC sensor during a non-output operation of the image forming apparatus 10 and may physically align output waveforms based on the control voltage.

Figure 5:
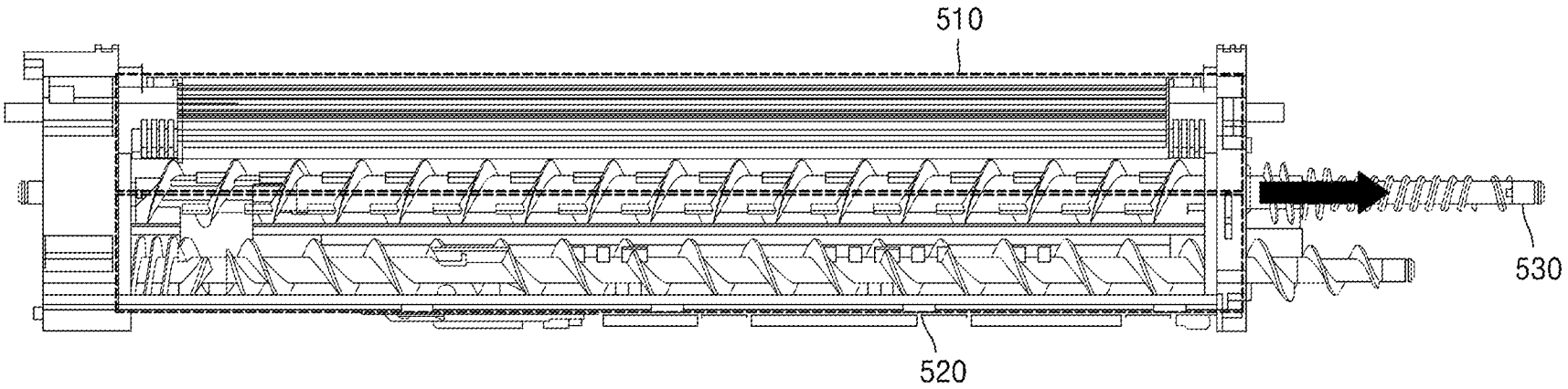
FIG. 5 is a view of a process of discharging developer by changing a distribution of the developer according to a change of a driving speed of a developing apparatus, according to an example.

FIG. 5 is a view of a process of discharging a developer by changing a distribution of the developer according to a change of a driving speed of a developing apparatus, according to an example.

FIG. 5 shows an inside of the developing apparatus 1110 of the image forming apparatus 10. The developing apparatus 1110 may be divided into a first area 510 and a second area 520. In addition, the developing apparatus 1110 may have a vertical structure in which a position of the first area 510 is higher than a position of the second area 520. A structure for the first area 510 and a structure for the second area 520 may be connected to each other by a gear. A developer in the developing apparatus 1110 may be transferred by an auger. While the auger is rotated, a portion of the developer distributed in the first area 510 may be transferred to the second area 520 and a portion of the developer distributed in the second area 520 may be transferred to the first area 510. In this case, the amount of the developer distributed in the first area 510 and the amount of the developer distributed in the second area 520 may vary according to a driving speed of the developing apparatus 1110.

For example, as the driving speed of the developing apparatus 1110 is slower, the amount of the developer distributed in the second area 520 may be greater than the amount of the developer distributed in the first area 510. That is, at a point of time when the driving speed of the developing apparatus 1110 is reduced, the developer may be relocated for a certain period of time due to the difference between the amount of the developer distributed in the first area 510 and the amount of the developer distributed in the second area 520 in the developing apparatus 1110. That is, the image forming apparatus 10 may induce a change in distribution of the developer according to a change in the driving speed of the developing apparatus 1110, and may discharge the amount of the developer from the developing apparatus 1110 through an outlet 530 for a certain period of time.

Meanwhile, the developing apparatus 1110 may be charged with the amount of developer exceeding a reference amount of the developer. The reference amount of the developer is the amount of developer to be maintained in the developing apparatus 1110 in order to smoothly perform the image forming job in the image forming apparatus 10. Therefore, when the developing apparatus 1110 is charged with the amount of the developer exceeding the reference amount of the developer, the image forming apparatus 10 may execute a discharge mode for discharging the developer and controlling an amount of the developer. In more detail, the image forming apparatus 10 controls the developing apparatus 1110 to be driven at a lower driving speed from a normal driving speed, and then controls the developing apparatus 1110 to be driven at the normal driving speed from the lower driving speed, thereby discharging the excess amount of the developer through the outlet 530.

Figure 6:
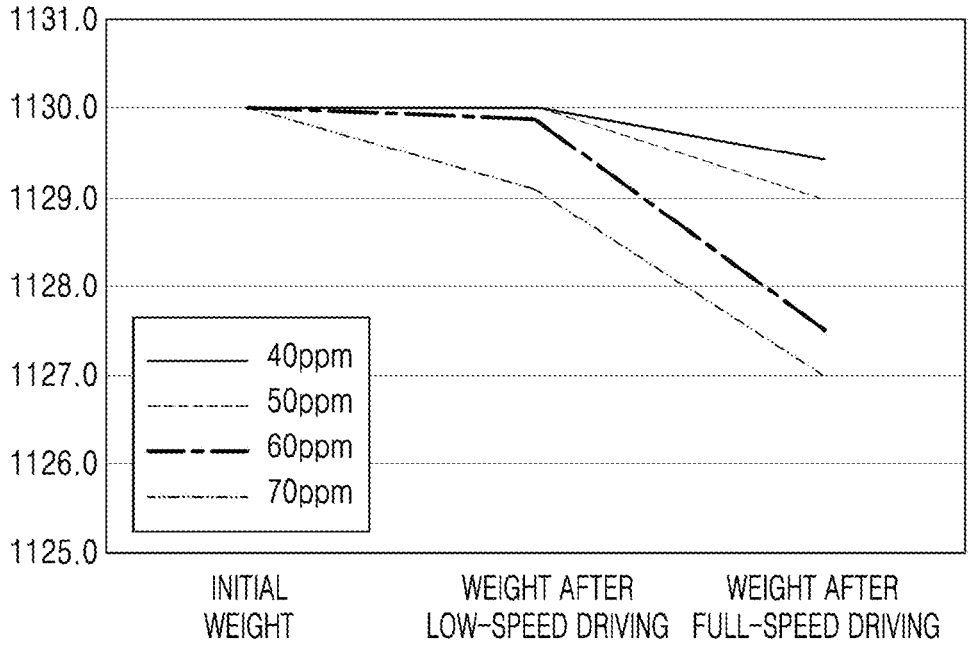
FIG. 6 is a view for explaining the amount of developer discharged according to a driving speed when the amount of developer exceeding a reference amount of the developer is filled in a developing apparatus, according to an example.

FIG. 6 is a view for explaining the amount of developer discharged according to a driving speed when the amount of developer exceeding a reference amount of the developer is filled in a developing apparatus, according to an example.

Referring to a table 610 of FIG. 6, the developing apparatus 1110 may be charged with the amount of the developer exceeding the reference amount of the developer. For example, an initial weight of the developing apparatus 1110 charged with the amount of the developer exceeding the reference amount of the developer may be 1130 g. The image forming apparatus 10 may control a driving speed of the developing apparatus 1110 to discharge a portion of the developer.

For example, the developing apparatus 1110 may be set to be driven at 70 ppm (page per minute) during an image forming job in the image forming apparatus 10. When the amount of the developer in the developing apparatus 1110 exceeds the reference amount of the developer, the image forming apparatus 10 may induce the discharge of the developer from the developing apparatus 1110 while changing a driving speed of the developing apparatus 1110. The developing apparatus 1110 may be driven at a speed less than 70 ppm and then driven at a maximum speed. The maximum speed is 70 ppm, which is the full speed. For example, the slower speed than 70 ppm is 20 ppm.

Referring to the table 610 and the graph 620 in FIG. 6, when the image forming apparatus 10 reduces a driving speed of the developing apparatus 1110 from 70 ppm to 20 ppm in an initial state, 0.9 g of the developer may be discharged from the developing apparatus 1110. Thereafter, when the image forming apparatus 10 increases the driving speed of the developing apparatus 1110 from 20 ppm to 70 ppm, 2.1 g of the developer may be discharged from the developing apparatus 1110. As the developing apparatus 1110 is driven at the full speed after low-speed driving in the initial state, 3.0 g of the developer may be discharged from the developing apparatus 1110.

As another example, the developing apparatus 1110 may be set to be driven at 60 ppm during the image forming job in the image forming apparatus 10. When the amount of the developer in the developing apparatus 1110 exceeds the reference amount of the developer, the image forming apparatus 10 may induce the discharge of the developer from the developing apparatus 1110 while changing a driving speed of the developing apparatus 1110. Referring to the table 610 and the graph 620 in FIG. 6, when the image forming apparatus 10 reduces the driving speed of the developing apparatus 1110 from 60 ppm to 20 ppm in the initial state, 0.1 g of the developer may be discharged from the developing apparatus 1110. Thereafter, when the image forming apparatus 10 increases the driving speed of the developing apparatus 1110 from 20 ppm to 60 ppm, 2.4 g of the developer may be discharged from the developing apparatus 1110. As the developing apparatus 1110 is driven at the full speed after the low-speed driving in the initial state, 2.5 g of the developer may be discharged from the developing apparatus 1110.

As another example, the developing apparatus 1110 may be set to be driven at 50 ppm during the image forming job in the image forming apparatus 10. When the amount of the developer in the developing apparatus 1110 exceeds the reference amount of the developer, the image forming apparatus 10 may induce the discharge of the developer from the developing apparatus 1110 while changing the driving speed of the developing apparatus 1110. Referring to the table 610 and the graph 620 in FIG. 6, when the image forming apparatus 10 reduces the driving speed of the developing apparatus 1110 from 50 ppm to 20 ppm in the initial state, developer may not be discharged from the developing apparatus 1110. Thereafter, when the image forming apparatus 10 increases the driving speed of the developing apparatus 1110 from 20 ppm to 50 ppm, 1 g of the developer may be discharged from the developing apparatus 1110. As the developing apparatus 1110 is driven at the full speed after the low-speed driving in the initial state, 1 g of the developer may be discharged from the developing apparatus 1110.

As another example, the image forming apparatus 10 may control the developing apparatus 1110 to be driven at 40 ppm during the image forming job. Referring to the table 610 and the graph 620 in FIG. 6, when the amount of the developer in the developing apparatus 1110 exceeds the reference amount of the developer, 0.6 g of the developer may be discharged from the developing apparatus 1110 as the developing apparatus 1110 is driven at the full speed of 40 ppm after low-speed driving of 20 ppm in the initial state.

Referring again to FIG. 5, in a case where the driving speed of the developing apparatus 1110 is greater than in a case where the driving speed of the developing apparatus 1110 is lower, the developer distributed in the second area 520 is smoothly supplied to the first area 510. Therefore, the amount of the developer to be discharged may be increased as the driving speed of the developing apparatus 1110 is increased. Meanwhile, as the driving speed of the developing apparatus 1110 decreases, the amount of developer to be discharged due to the decrease in the driving speed of the developing apparatus 1110 may be reduced.

When the developing apparatus 1110 is charged with the amount of developer exceeding the reference amount of the developer, the image forming apparatus 10 may execute a discharge mode for discharging the developer and controlling the amount of the developer. For example, the image forming apparatus 10 may execute a discharge mode at high-speed driving at which developer is discharged when the driving speed of the developing apparatus 1110 is greater than a preset speed. The image forming apparatus 10 may discharge a first amount of the developer while reducing the driving speed of the developing apparatus 1110 from a first speed to a second speed less than the preset speed during a first driving time. Thereafter, the image forming apparatus 10 may discharge a second amount of the developer while increasing the driving speed of the developing apparatus 1110 from the second speed to the first speed during a second driving time. The second amount of the developer may be greater than the first amount of the developer. Also, the first driving time and the second driving time may be the same.

Figure 7:
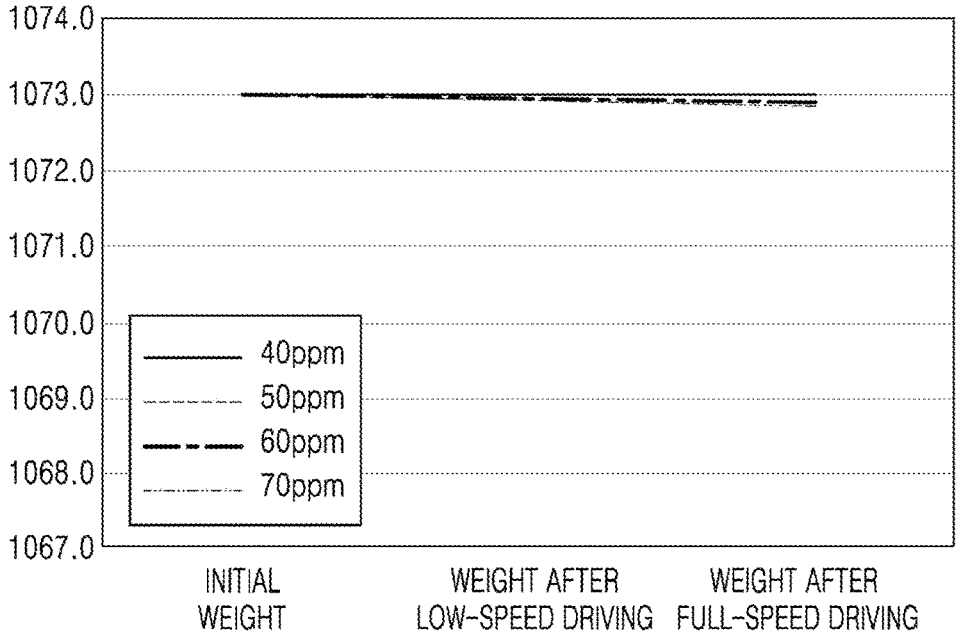
FIG. 7 is a view for explaining the amount of developer discharged according to a driving speed when the reference amount of developer is filled in a developing apparatus, according to an example.

FIG. 7 is a view for explaining the amount of developer discharged according to a driving speed when the reference amount of the developer is filled in a developing apparatus, according to an example.

Referring to a table 710 of FIG. 7, the developing apparatus 1110 may be charged with the reference amount of developer. For example, an initial weight of the developing apparatus 1110 charged with the reference amount of the developer may be 1073 g. In this case, the amount of developer to be discharged from the developing apparatus 1110 is almost zero according to a change in a driving speed of the developing apparatus 1110, and the excessive amount of the developer may be discharged.

For example, the developing apparatus 1110 may be set to be driven at 70 ppm during an image forming job in the image forming apparatus 10. Referring to the table 710 and the graph 720 of FIG. 7, when the image forming apparatus 10 reduces the driving speed of the developing apparatus 1110 from 70 ppm to 20 ppm in an initial state, the amount of developer to be discharged from the developing apparatus 1110 is zero. Thereafter, when the image forming apparatus 10 increases the driving speed of the developing apparatus 1110 from 20 ppm to 70 ppm, 0.1 g of the developer may be discharged from the developing apparatus 1110.

Similarly, the developing apparatus 1110 may be set to be driven at 60 ppm, 50 ppm, and 40 ppm during the image forming job in the image forming apparatus 10. Referring to the table 710 and the graph 720 of FIG. 7, when the image forming apparatus 10 sequentially reduces the driving speed of the developing apparatus 1110 from 60 ppm, 50 ppm, and 40 ppm to 20 ppm in an initial state, the amount of developer to be discharged from the developing apparatus 1110 is zero. Thereafter, when the image forming apparatus 10 sequentially increases the driving speeds of the developing apparatus 1110 from 20 ppm to 60 ppm, from 20 ppm to 50 ppm, and from 20 ppm to 40 ppm during full-speed driving, a small amount of the developer may be discharged from the developing apparatus 1110.

That is, when the reference amount of the developer is charged in the developing apparatus 1110 or the reference amount of the developer is maintained at a driving speed set in the developing apparatus 1110, the amount of developer to be discharged from the developing apparatus 1110 is almost zero according to a change in the driving speed of the developing apparatus 1110, and the excessive amount of the developer may be discharged.

Figure 8:
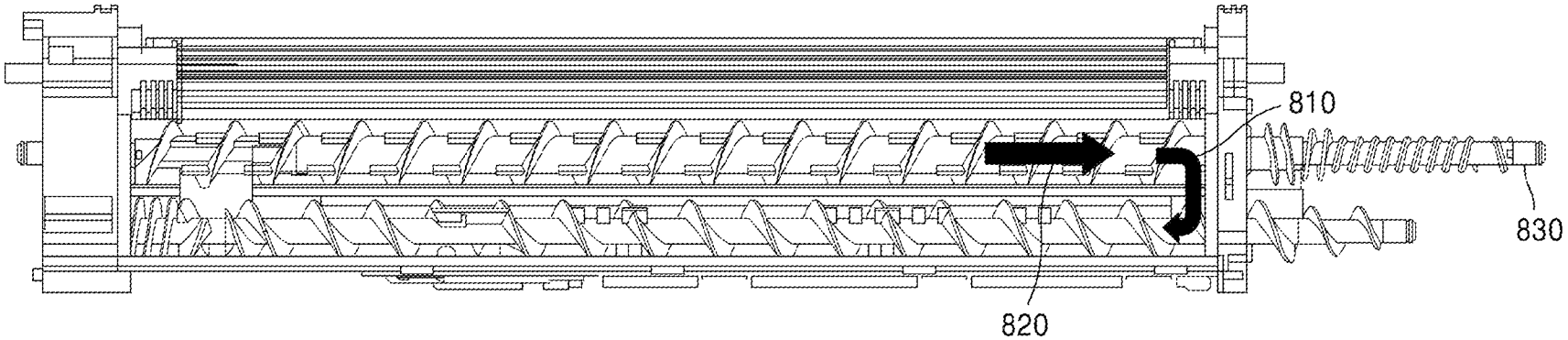
FIG. 8 is a view of a process of discharging developer according to an increase in a driving speed of a developing apparatus, according to an example.

FIG. 8 is a view of a process of discharging developer according to an increase in a driving speed of a developing apparatus, according to an example.

FIG. 8 shows an inside of the developing apparatus 1110 of the image forming apparatus 10. A structure of the developing apparatus 1110 shown in FIG. 8 may be the same as that of the developing apparatus 1110 shown in FIG. 5. Developer in the developing apparatus 1110 may be transferred by an auger. The developer in the developing apparatus 1110 may be circulated in a clockwise direction 810 as the auger is rotated.

Meanwhile, when a driving speed of the developing apparatus 1110 is increased, the force that developer in an upper region in the developing apparatus receives in a right direction 820 may be increased, as shown in FIG. 8. The upper region in the developing apparatus 1110 may correspond to the first area 510 shown in FIG. 5.

Accordingly, as the magnitude of the driving speed of the developing apparatus 1110 is increased, the force acting in the right direction 820 may be increased in proportion thereto, and the developer may be discharged through an outlet 830. That is, the higher the driving speed of the developing apparatus 1110, the more the developer may be discharged.

Meanwhile, the developing apparatus 1110 may be charged with the amount of developer exceeding a reference amount of the developer. Therefore, when the developing apparatus 1110 is charged with the amount of the developer exceeding the reference amount of the developer, the image forming apparatus 10 may execute a discharge mode for discharging the developer and controlling the amount of the developer. For example, the image forming apparatus 10 may execute a discharge mode at a lower driving speed at which the driving speed of the developing apparatus 1110 is less than a preset speed. The image forming apparatus 10 may increase the driving speed of the developing apparatus 1110 to a speed greater than the preset speed so that the amount of the developer exceeding the reference amount of the developer in the developing apparatus 1110 may be discharged through the outlet 830.

Figure 9:
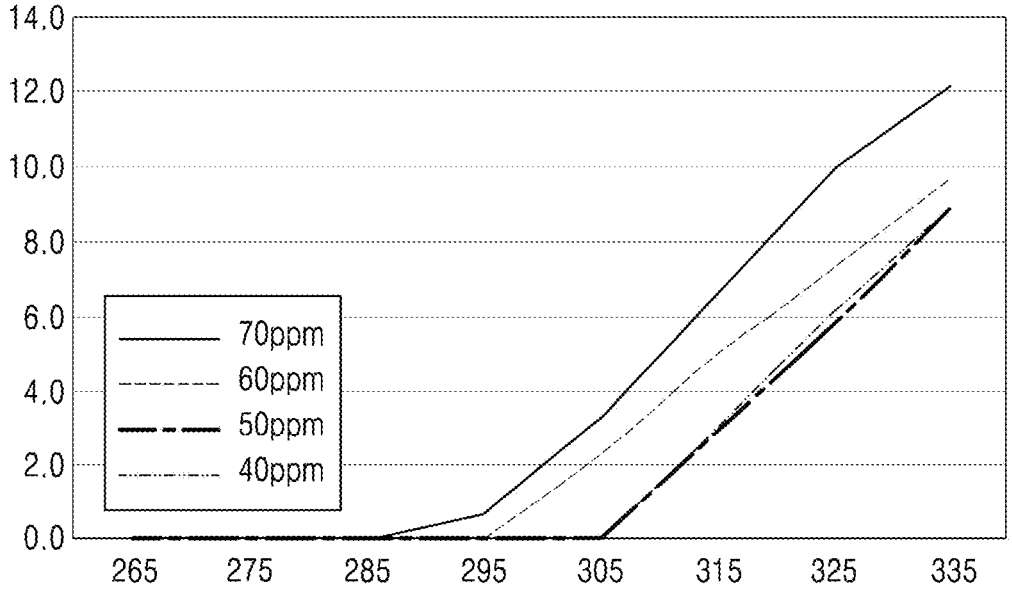
FIG. 9 is a view for explaining the amount of developer discharged according to a driving speed of a developing apparatus, according to an initial amount of developer charged in the developing apparatus, according to an example.

FIG. 9 is a view for explaining the amount of developer discharged according to a driving speed of a developing apparatus, according to an initial amount of developer charged in the developing apparatus, according to an example.

The image forming apparatus 10 may control the developing apparatus 1110 such that the developing apparatus 1110 charged with a certain amount of the developer is driven for each of a plurality of driving speeds. A table 910 in FIG. 9 shows the amount of developer to be discharged when the developing apparatus 1110 charged with the certain amount of the developer is driven for each of the plurality of driving speeds.

Referring to the table 910 of FIG. 9, a starting speed at which a developer is discharged and the amount of the developer to be discharged may be different depending on the amount of initial charge of the developer from the developing apparatus 1110. That is, referring to the amount of the developer discharged from the developing apparatus 1110 depending on the driving speed of the developing apparatus 1110 in the certain amount of the developer charged in the developing apparatus 1110, for example, when the amount of initial charge of the developer is 295 g and when the driving speed of the developing apparatus 1110 reaches 70 ppm, the developer starts to be discharged and 0.7 g of the developer may be discharged. Meanwhile, when the amount of initial charge of the developer is 305 g and when the driving speed of the developing apparatus 1110 reaches 60 ppm, the developer starts to be discharged and 2.2 g of the developer may be discharged.

Furthermore, when the amounts of initial charge of the developer are 315 g, 325 g, and 335 g, the developer may be discharged even when the developing apparatus 1110 reaches a driving speed of 40 ppm. In this case, as the driving speed of the developing apparatus 1110 increases, the force acting on an outlet of the developing apparatus 1110 increases, and the amount of the developer to be discharged from the developing apparatus 1110 may also be increased.

Also, when the amounts of initial charge of the developer are 265 g, 275 g, and 285 g, even if the driving speed of the developing apparatus 1110 is increased from 40 ppm to 70 ppm by 10 ppm, the developer may not be discharged from the developing apparatus 1110.

Meanwhile, referring to the amount of initial charge of a developer and the amount of developer to be discharged from the developing apparatus 1110 at a certain driving speed, when the driving speed of the developing apparatus 1110 is 40 ppm, the amount of the developer to be discharged may increase as the amount of initial charge of the developer increases from when the amount of initial charge of the developer of the developing apparatus 1110 is 315 g. Likewise, when the driving speed of the developing apparatus 1110 is 50 ppm, the amount of the developer to be discharged may increase as the amount of initial charge of the developer increases from when the amount of initial charge of the developer of the developing apparatus 1110 is 315 g.

Meanwhile, when the driving speed of the developing apparatus 1110 is 60 ppm, the amount of the developer to be discharged may increase as the amount of initial charge of the developer increases from when the amount of initial charge of the developer of the developing apparatus 1110 is 305 g. Also, when the driving speed of the developing apparatus 1110 is 60 ppm, the amount of the developer to be discharged may increase as the amount of initial charge of the developer increases from when the amount of initial charge of the developer of the developing apparatus 1110 is 295 g.

That is, the amount of initial charge of the developer from which the developer starts to be discharged at each driving speed of the developing apparatus 1110 may vary. Further, as the amount of initial charge of the developer to be charged after the start of the discharge of the developer at a certain driving speed of the developing apparatus 1110 is increased, the amount of the discharged developer may be increased. Furthermore, when the developer is discharged from the developing apparatus 1110 charged with a certain amount of initial charge of the developer at the certain driving speed of the developing apparatus 1110, the amount of the developer to be discharged may be increased as the driving speed of the developing apparatus 1110 increases.

When the developing apparatus 1110 is charged with the amount of developer exceeding a reference amount of the developer, the image forming apparatus 10 may execute a discharge mode for discharging the developer and controlling the amount of the developer. For example, the image forming apparatus 10 may execute a discharge mode at a lower driving speed at which the driving speed of the developing apparatus 1110 is less than a preset speed. In more detail, the image forming apparatus 10 may increase the driving speed of the developing apparatus 1110 to a driving speed designed to maintain the reference amount of the developer according to driving of the developing apparatus 1110 during a third driving time, thereby discharging the amount of the developer exceeding the reference amount of the developer from the developing apparatus 1110.

FIG. 10 is a view for explaining a driving time set according to a driving speed of a developing apparatus in a discharge mode of the developing apparatus, according to an example.

The volume of a developer in the developing apparatus 1110 may be changed depending on the amount of developer supplied to the developing apparatus 1110. Further, the volume of the developer may vary depending on the external environment. For example, the volume of the developer may be changed depending on whether the temperature of the external environment is high or low. Further, the volume of the developer may be changed depending on whether the humidity of the external environment is high or low.

Depending on a model of the developing apparatus 1110, the driving speed of the developing apparatus 1110 to be driven during an image forming job may be set in advance. Therefore, when a discharge mode of the developing apparatus 1110 is executed in the image forming apparatus 10, the image forming apparatus 10 may execute a discharge mode at high-speed driving or a discharge mode in low-speed driving depending on a driving speed set in the developing apparatus 1110.

The operation of the developing apparatus 1110 in relation to the discharge mode of the developing apparatus 1110 in the high-speed driving is described in FIGS. 5 to 7, and the operation of the developing apparatus 1110 in relation to the discharge mode of the developing apparatus 1110 in the low-speed driving is described in FIGS. 8 and 9.

A table 1010 of FIG. 10 shows a driving time according to the driving speed of the developing apparatus 1110 in a discharge mode of an environment where temperature and humidity become lower towards E10. Meanwhile, the table 1010 of FIG. 10 shows a driving time according to the driving speed of the developing apparatus 1110 in a discharge mode of an environment where temperature and humidity become higher towards E110.

Figure 11:
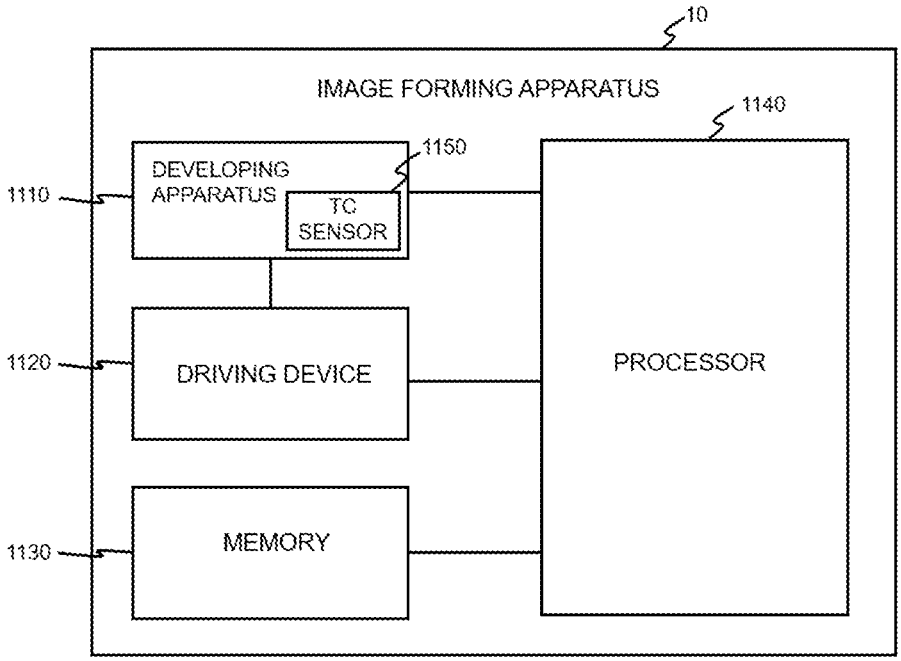
FIG. 11 is a block diagram of a configuration of an image forming apparatus according to an example.

FIG. 11 is a block diagram of a configuration of an image forming apparatus according to an example.

The image forming apparatus 10 shown in FIG. 11 may include a developing apparatus 1110, a driving device 1120, a memory 1130, and a processor 1140. However, not all elements shown in the drawings are necessary elements. The image forming apparatus 10 may include more or less elements than the elements shown in the drawings. Hereinafter, the elements will be described.

The developing apparatus 1110 may rotatably support a developing roller for supplying toner to a photoconductor. The developing apparatus 1110 may include a TC sensor 1150 configured to measure a toner concentration of a developer including toner and a carrier. The driving device 1120 may drive the developing apparatus 1110. The processor 1140 controls the driving device 1120 such that the developing apparatus 1110 may be driven by the driving device 1120. The processor 1140 may control the operation of the driving device 1120 according to a driving speed of the developing apparatus 1110.

The memory 1130 may store programs, data or files associated with the image forming apparatus 10. For example, the processor 1140 may execute a program stored in the memory 1130, read data or a file stored in the memory 1130, or store a new file in the memory 1130. The memory 1130 may store program commands, data files, data structures or a combination thereof. The memory 1130 may store instructions executable by the processor 1140.

For example, the memory 1130 may obtain an output waveform corresponding to the volume of the developer stored in the developing apparatus 1110 via a TC sensor, and may store a program for controlling the amount of the developer in the developing apparatus 1110 based on a result of comparing a characteristic value calculated from the output waveform with a reference value. Further, the memory 1130 may store data, an output waveform, and the like related to the toner concentration obtained by the TC sensor. Also, the memory 1130 may store a reference value calculated from a reference output waveform obtained in an initial state of the developing apparatus 1110.

In addition, the memory 1130 may store a driving time set according to the driving speed of the developing apparatus 1110 in a discharge mode of the developing apparatus 1110.

The processor 1140 controls overall operations of the image forming apparatus 10, and may include at least one processor, such as a central processing unit (CPU). The memory 1130 may include at least one specialized processor corresponding to each function, or may be a single integrated processor.

The processor 1140 may control the TC sensor to measure a toner concentration of the developer stored in the developing apparatus 1110 and may obtain an output waveform output from the TC sensor. The TC sensor may be installed in the developing apparatus 1110.

The processor 1140 may adjust a control voltage applied to the TC sensor during a non-output operation of the image forming apparatus 10. The TC sensor may perform physical alignment on a maximum voltage of the output waveform with a preset reference voltage based on the control voltage. The processor 1140 may obtain a corrected output waveform according to the physical alignment.

The processor 1140 may obtain a first characteristic value corresponding to the volume of the developer, based on the output waveform.

For example, the image forming apparatus 10 may calculate an RMS value of the corrected output waveform to obtain the first characteristic value.

The processor 1140 may compare the first characteristic value with a reference value. The processor 1140 may determine whether to execute a discharge mode for discharging the developer from the developing apparatus 1110 and to control an amount of the developer based on a result of the comparison.

Here, the reference value is a value calculated from a reference output waveform of the developing apparatus 1110. The reference output waveform is a waveform in which a toner concentration of the developer in an initial state of the developing apparatus 1110 through the TC sensor is measured and output.

For example, before the developing apparatus 1110 is newly installed in the image forming apparatus 10 and a first image forming job is performed in the image forming apparatus 10, the processor 1140 may measure a toner concentration of the developer stored in the developing apparatus 1110 through the TC sensor to obtain a reference output waveform. The processor 1140 may obtain an RMS value of the reference output waveform and store the RMS value as the reference value of the developing apparatus 1110.

For example, when a difference between the reference value and the first characteristic value is greater than a preset value, the processor 1140 may determine that the amount of the developer in the developing apparatus 1110 exceeds the reference amount of developer. The reference amount of developer is the amount of the developer to be maintained in the developing apparatus 1110 in order to smoothly perform an image forming job in the image forming apparatus 10. The processor 1140 may determine execution of a discharge mode to maintain the amount of the developer in the developing apparatus 1110 at the reference amount of the developer.

Meanwhile, a time at which the processor 1140 determines whether to execute the discharge mode may be a time of execution of a preparation operation of the image forming apparatus 10. Further, when it is determined that the processor 1140 is to execute the discharge mode, the processor 1140 may output alarm information regarding execution of the discharge mode.

When the discharge mode is executed in the image forming apparatus 10 according to a result of the determining whether or not the discharge mode is executed, the processor 1140 may discharge a portion of the developer in the developing apparatus 1110 by controlling the driving speed of the developing apparatus 1110.

For example, when the discharge mode is executed at a first speed at which a driving speed of the developing apparatus 1110 is greater than a preset speed, the processor 1140 may induce a change in the distribution of the developer in the developing apparatus 1110 in accordance with a change of reducing and then increasing the driving speed of the developing apparatus 1110. The processor 1140 may control the developing apparatus 1110 to discharge the amount of developer exceeding the reference amount of the developer due to the change in the distribution of the developer in the developing apparatus 1110.

In more detail, the processor 1140 may control the developing apparatus 1110 and the driving device 1120 to discharge a first amount of the developer from the developing apparatus 1110 while reducing the driving speed of the developing apparatus 1110 from the first speed to a second speed less than the preset speed during a first driving time. The image forming apparatus 10 may control the developing apparatus 1110 and the driving device 1120 to discharge a second amount of the developer from the developing apparatus 1110 while increasing the driving speed of the developing apparatus 1110 from the second speed to the first speed during a second driving time.

In another example, when the discharge mode is executed at a speed at which the driving speed of the developing apparatus 1110 is less than a preset speed, the processor 1110 may control to discharge the amount of developer exceeding a reference amount of the developer by increasing the driving speed of the developing apparatus 1110 to a speed greater than the preset speed.

In more detail, the image forming apparatus 10 may increase the driving speed of the developing apparatus 1110 to a driving speed designed to maintain the reference amount of the developer according to driving of the developing apparatus 1110 during a third driving time, thereby controlling the developing apparatus 1110 and driving device 1120 to discharge the amount of the developer exceeding the reference amount of the developer from the developing apparatus 1110.

Meanwhile, the above-described operating method of the image forming apparatus 10 may be implemented in the form of a non-transitory computer-readable recording medium storing instructions or data executable by a computer or a processor. The examples may be written as computer programs and may be implemented in general-use digital computers that execute programs using the computer-readable recording medium. The computer-readable recording medium may include read only memory (ROM), random access memory (RAM), flash memory, CD-ROMs, CD-Rs, CD+Rs, CD-DVD-Rs, DVD-Rs, DVD-RWs, DVD+RWs, DVD-RAMs, BD-ROMs, BD-Rs, BD-R LTHs, BD-REs, magnetic tapes, floppy disks, magneto-optical data storage devices, optical data storage devices, hard disks, or solid-state disks (SSD), and may be any device capable of storing instructions or software, associated data, data files, and data structures, and providing the instructions or software, associated data, data files, and data structures to a processor or a computer such that the processor or computer may execute the instructions.

Although the examples have been described with reference to the accompanying drawings, various changes and modifications may be made therein. For example, the relevant results may be achieved even when the described technologies are performed in a different order than the described methods, and/or even when the described elements such as systems, structures, devices, and circuits are coupled or combined in a different form than the described methods or are replaced or substituted by other elements or equivalents.

Therefore, the scope of the disclosure should be defined not by the described examples alone, but by the appended claims and the equivalents thereof.

What is claimed is:

1. A method, comprising:

measuring, using a toner concentration sensor installed in a developing apparatus of an image forming apparatus, a toner concentration of a developer stored in the developing apparatus and obtaining an output waveform corresponding to the toner concentration of the developer;

calculating, based on the output waveform, a first characteristic value which corresponds to a volume of the developer;

determining whether to execute a discharge mode for discharging the developer from the developing apparatus based on a comparison of the first characteristic value with a reference value calculated from a reference output waveform; and based on the discharge mode being executed according to a result of the determining, controlling a driving speed of the developing apparatus to discharge a portion of the developer from the developing apparatus.

2. The method of claim 1, wherein the obtaining of the output waveform comprises:

adjusting a control voltage applied to the toner concentration sensor during a non-output operation of the image forming apparatus; and obtaining a corrected output waveform by aligning a value of a maximum voltage of the output waveform with a preset reference voltage based on the control voltage.

3. The method of claim 2, wherein the calculating of the first characteristic value comprises:

calculating a root mean square (RMS) value of the corrected output waveform.

4. The method of claim 1, further comprising:

obtaining a root mean square (RMS) value of the reference output waveform output from the toner concentration sensor before the developing apparatus is newly installed in the image forming apparatus and a first image forming job is performed in the image forming apparatus; and storing the RMS value of the reference output waveform as the reference value of the developing apparatus.

5. The method of claim 1, wherein the determining of whether to execute the discharge mode comprises:

determining whether an amount of the developer from the developing apparatus exceeds a reference amount of the developer based on a difference value between the reference value and the first characteristic value; and based on the difference value between the reference value and the first characteristic value being greater than a preset value, determining to execute the discharge mode so that the amount of the developer from the developing apparatus is maintained at the reference amount of the developer.

6. The method of claim 1, wherein, based on the discharge mode being executed at a first speed at which the driving speed of the developing apparatus is greater than a preset speed, controlling the driving speed of the developing apparatus to discharge the portion of the developer from the developing apparatus comprises:

discharging an amount of developer which exceeds a reference amount of the developer from the developing apparatus by inducing a change in distribution of the developer from the developing apparatus by reducing the driving speed of the developing apparatus and then increasing the driving speed of the developing apparatus.

7. The method of claim 6, wherein the discharging the amount of the developer which exceeds the reference amount of the developer comprises:

discharging a first amount of the developer while reducing the driving speed of the developing apparatus from the first speed to a second speed which is less than the preset speed during a first driving time; and discharging a second amount of the developer while increasing the driving speed of the developing apparatus from the second speed to the first speed during a second driving time.

8. The method of claim 1, wherein, based on the discharge mode being executed at a speed at which the driving speed of the developing apparatus is less than a preset speed, controlling the driving speed of the developing apparatus to discharge the portion of the developer from the developing apparatus comprises:

discharging an amount of the developer which exceeds a reference amount of the developer from the developing apparatus by increasing the driving speed of the developing apparatus to a speed which is greater than the preset speed.

9. The method of claim 8, wherein the discharging the amount of the developer which exceeds the reference amount of the developer from the developing apparatus comprises:

discharging the amount of the developer which exceeds the reference amount of the developer from the developing apparatus by increasing the driving speed of the developing apparatus to a driving speed which maintains the reference amount of the developer during a preset driving time.

10. The method of claim 8, wherein determining whether to execute the discharge mode comprises:

determining whether to execute the discharge mode at a time of execution of a preparation operation of the image forming apparatus; and outputting alarm information regarding execution of the discharge mode based on it being determined that the discharge mode is to be executed.

11. A non-transitory machine-readable storage medium encoded with instructions executable by a processor, the non-transitory machine-readable storage medium comprising instructions for:

measuring, using a toner concentration sensor installed in a developing apparatus of an image forming apparatus, a toner concentration of a developer stored in the developing apparatus and obtaining an output waveform corresponding to the toner concentration of the developer;

calculating, based on the output waveform, a first characteristic value which corresponds to a volume of the developer;

determining whether to execute a discharge mode for discharging the developer from the developing apparatus based on a comparison of the first characteristic value with a reference value calculated from a reference output waveform; and based on the discharge mode being executed according to a result of the determining, controlling a driving speed of the developing apparatus to discharge a portion of the developer from the developing apparatus.

12. An image forming apparatus, comprising:

a developing apparatus comprising a toner concentration sensor to measure a toner concentration of a developer stored in the developing apparatus;

a driving device to drive the developing apparatus;

a memory to store instructions; and a processor to execute the instructions stored in the memory to:

control the toner concentration sensor to measure the toner concentration of the developer stored in the developing apparatus to obtain an output waveform, calculate, based on the output waveform, a first characteristic value which corresponds to a volume of the developer, determine whether to execute a discharge mode for discharging the developer from the developing apparatus based on a comparison of the first characteristic value with a reference value calculated from a reference output waveform, and based on the discharge mode being executed according to a result of the determining, control the driving device so as to control a driving speed of the developing apparatus to discharge a portion of the developer from the developing apparatus.

13. The image forming apparatus of claim 12, wherein the processor is to execute the instructions stored in the memory to:

control the driving device to adjust a control voltage applied to the toner concentration sensor during a non-output operation of the image forming apparatus, obtain a corrected output waveform by aligning a value of a maximum voltage of the output waveform with a preset reference voltage based on the control voltage, and calculate a root mean square (RMS) value of the corrected output waveform.

14. The image forming apparatus of claim 12, wherein, based on the discharge mode being executed at a first speed at which the driving speed of the developing apparatus is greater than a preset speed, the processor is to execute the instructions stored in the memory to:

induce a change in distribution of the developer from the developing apparatus based on a control operation which reduces the driving speed of the developing apparatus and then increases the driving speed, and discharge, according to the change of the distribution of the developer, an amount of the developer which exceeds a reference amount of the developer from the developing apparatus.

15. The image forming apparatus of claim 12, wherein, based on the discharge mode being executed at a speed at which the driving speed of the developing apparatus is less than a preset speed, the processor is to execute the instructions stored in the memory to:

discharge an amount of the developer which exceeds a reference amount of the developer from the developing apparatus based on a control operation which increases the driving speed of the developing apparatus to a speed greater than the preset speed.

* * * * *